US008011752B2

(12) United States Patent
Kojima

(10) Patent No.: US 8,011,752 B2
(45) Date of Patent: Sep. 6, 2011

(54) IMAGE RECORDING APPARATUS

(75) Inventor: Toshiya Kojima, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 349 days.

(21) Appl. No.: 12/413,003

(22) Filed: Mar. 27, 2009

(65) Prior Publication Data

US 2009/0244169 A1 Oct. 1, 2009

(30) Foreign Application Priority Data

Mar. 28, 2008 (JP) ..... 2008-085795

(51) Int. Cl.
*B41J 2/165* (2006.01)

(52) U.S. Cl. ..... 347/23; 347/33; 347/34

(58) Field of Classification Search ..... 347/16, 347/23, 33–34

See application file for complete search history.

(56) References Cited

U.S. PATENT DOCUMENTS

| | | | | |
|---|---|---|---|---|
| 6,481,707 | B2 * | 11/2002 | Matsuo et al. | 271/109 |
| 2005/0264636 | A1 * | 12/2005 | Takito et al. | 347/104 |
| 2006/0192804 | A1 * | 8/2006 | Nakata et al. | 347/16 |

FOREIGN PATENT DOCUMENTS

| | | | |
|---|---|---|---|
| JP | 07-112556 | A | 5/1995 |
| JP | 2000-141818 | A | 5/2000 |
| JP | 2001-063158 | A | 3/2001 |
| JP | 2003-137447 | A | 5/2003 |

* cited by examiner

*Primary Examiner* — Julian D Huffman
*Assistant Examiner* — Jason S Uhlenhake
(74) *Attorney, Agent, or Firm* — Birch, Stewart, Kolasch & Birch, LLP

(57) ABSTRACT

An ink jet printer has a carriage equipped with a recording head. The carriage is disposed downstream in a feeding direction of a recording medium. The carriage has an optical sensor for measuring dirt on a supply roller. When the supply roller is dirty, a cleaning operation is started to rotate the supply roller as being pressed onto a separation pad. The dirt on the supply roller is measured with the optical sensor, and the cleaning operation lasts until the dirt is removed from the supply roller.

10 Claims, 9 Drawing Sheets

63

| MEDIA TYPE | OUTPUT DECREASE DATA |
|---|---|
| A | Va |
| B | Vb |
| C | Vc |
| ⋮ | ⋮ |

IMAGE RECORDING APPARATUS

FIELD OF THE INVENTION

The present invention relates to an image recording apparatus with a supply roller cleaning function.

BACKGROUND OF THE INVENTION

There are known ink jet printers to record images by ejecting droplets of ink from an ink jet recording head to a sheet of recording medium. Generally, the ink jet printers have a supply roller to feed recording media stacked on a paper supply tray into a printer main body. The paper supply tray is generally provided with a separation pad allocated to face the supply roller. The separation pad prevents several recording media from being grabbed on top of the other at a time and fed into the printer main body. The supply roller sends forth the recording media while pressing them against the separation pad. The separation pad holds the recording media in the paper supply tray with a frictional force, allowing an uppermost recording medium to be fed into the main body at a time.

The supply roller is made of an elastic material, such as rubber, so that it can produce a strong frictional force against the recording medium. This supply roller is, however, easily covered with powders (fine paper powder) peeled off from the recording medium, and gradually lowers its frictional force over repetition of the feeding operation. Having fed a certain number of recording media, the ink jet printers show a decline in the feeding performance, changing a feeding cycle and causing a paper-pick (jamming) problem. Especially, compact personal printers generally have their supply rollers outside the casings, and allow the dust from outside to stick to the supply roller.

A method to solve this drawback is disclosed in the prior art (see, for example, U.S. Pat. No. 6,932,523 and Japanese Patent Laid-open Publication No. 2003-137447). This method includes a cleaning operation to press the supply roller onto the separation pad, and rotate the supply roller a predetermined number of times (about 20 times), so as to remove paper powders and dust on the supply roller with the separation pad to recover the frictional force. Some ink jet printers with this type of cleaning function have a sensor to detect dirt (dust) on the supply roller, and start the cleaning operation when the sensor detects a dirty spot (see, for example, Japanese Patent Laid-open Publications No. 2000-141818 and No. 07-112556).

However, in the cleaning operation of the U.S. Pat. No. 6,932,523 and the publication No. 2003-137447, the supply roller is always rotated the same number of times, irrespective of the degree of dirt on the supply roller. This may end up in continuing the cleaning operation for an unnecessarily long period to waste time when the supply roller is not very dirty. When the supply roller is very dirty, on the contrary, the cleaning operation may last before the dirt is removed completely.

Although the publications No. 2000-141818 and No. 07-112556 disclose detecting dirt to start the cleaning operation, they are silent about how long the cleaning operation should be continued. Therefore, these publications do not cure the deficiency of the above prior art.

SUMMARY OF THE INVENTION

In view of the foregoing, it is a main object of the present invention to provide an ink jet recording apparatus to perform an effective cleaning operation by monitoring progress of removal of dirt from a supply roller.

Another object of the present invention is to provide an ink jet recording apparatus to estimate an increase of dirt on the supply roller in a serial printing operation, and perform the cleaning operation previous to the serial printing operation.

In order to achieve the above and other objects, an image recording apparatus according to the present invention includes a supply roller for feeding a sheet-like recording medium to a recording position, a carriage with a recording head, a dirt measuring sensor, a cleaning member for cleaning the supply roller and a cleaning controller. The carriage holds the recording head, and moves back and forth in a main scanning direction orthogonal to a feeding direction of the recording medium. The dirt measuring sensor is attached to the carriage, and measures dirt on the supply roller. The cleaning member makes contact with the rotating supply roller to clean it. The cleaning controller rotates the supply roller as being pressed onto the cleaning member, while monitoring the progress of dirt removal based on measurement results of the dirt measuring sensor during a cleaning operation. When the dirt is removed from the supply roller, the cleaning controller stops the rotation of the supply roller.

Preferably, the image recording apparatus further includes a pressure plate which holds a stack of recording media, and presses the uppermost recording medium onto the supply roller. In this case, the cleaning member is attached to the pressure plate.

It is also preferred that the carriage has a projecting part which hangs over the supply roller, and that the dirt measuring sensor is attached to an under surface of the projecting part. The recording head is preferably an ink jet recording head which ejects droplets of ink to the recording medium.

The supply roller preferably has an annular groove extending in a circumferential direction on the peripheral surface. The dirt measuring sensor measures first dirt on the peripheral surface and second dirt on a floor of the annular groove while the carriage moves in the main scanning direction. The cleaning controller compares the first dirt with the second dirt to judge whether or not the dirt of said supply roller is removed.

It is preferred to provide the image recording apparatus with a roller rotation counter for counting the number of rotations of the supply roller during the cleaning operation, and a first notification device for notifying that the supply roller needs to be replaced when the roller rotation counter counts up to a predetermined number during the cleaning operation.

It is also preferred to provide the image recording apparatus with a change rate calculator for calculating a rate of temporal change of dirt on the supply roller during the cleaning operation, and a second notification device for notifying that the supply roller has deteriorated when a calculated rate in the change rate calculator is below a predetermined rate of change.

It is preferred for the dirt measuring sensor to measure dirt on the supply roller every time the supply roller rotates a predetermined number of times.

More preferably, the image recording apparatus further includes a memory storing information about degree of dirt, an input device for entering the number of the recording media to be recorded serially, an estimator for estimating degree of dirt on the supply roller, and a third notification device. The memory stores the information about how much the supply roller becomes dirt in feeding a recording medium, according to the types of recording media. The estimator refers to the information in the memory, and estimates the degree of dirt, based on a measurement result of the dirt measuring sensor, the type of recording medium and the number of recording media to be recorded. When an estimated degree of dirt is on or above a predetermined threshold value, the third notification device notifies that the cleaning operation needs to be performed in advance of an image recording operation.

In another preferred embodiment of the present invention, the image recording apparatus includes a recording head, a supply roller for feeding a sheet-like recording medium to a recording position, a cleaning member for making contact with the rotating supply roller to remove dirt from a peripheral surface thereof, a memory storing information about how much said supply roller becomes dirt in feeding a recording medium, a dirt measuring sensor for measuring dirt on the supply roller, an input device for entering the number of the recording media to be recorded serially, an estimator for estimating degree of dirt on the supply roller, and a third notification device for notifying the need of a prior cleaning operation.

According to the present invention, the progress of dirt removal is monitored with the dirt measuring sensor, and the cleaning operation to rotate the supply roller lasts until the dirt is judged to be removed from the supply roller. In this manner, the cleaning operation is performed in accordance with the progress of dirt removal, and achieves effective cleaning that eliminates an excessive cleaning operation when there is little dirt while ensuring an adequate cleaning operation when there is much dirt.

A degree of dirt on the supply roller is estimated, based on the measurement result of the dirt measuring sensor, the type of recording medium, and the number of recording media to be recorded serially. When the estimated degree of dirt is on or above a predetermined threshold value, a notification to encourage a prior cleaning operation is provided. This prevents dirt from sticking heavily onto the supply roller during the serial printing to cause jamming and other feeding problems.

The annular groove is formed on the peripheral surface of the supply roller, and the degree of dirt is compared between the peripheral surface that touches the recording medium and the annular groove floor which does not touch the recording medium. Therefore, the measurement result is not affected by the material, color and temporal change of the supply roller.

The dirt measuring sensor is attached to the under surface of the projecting part, which hangs over the supply roller to blocks light, and improves the measurement accuracy of the dirt measuring sensor.

BRIEF DESCRIPTION OF THE DRAWINGS

The above objects and advantages of the present invention will become more apparent from the following detailed description when read in connection with the accompanying drawings, in which.

DETAILED DESCRIPTION OF THE PREFERRED EMBODIMENTS

Figure 1:
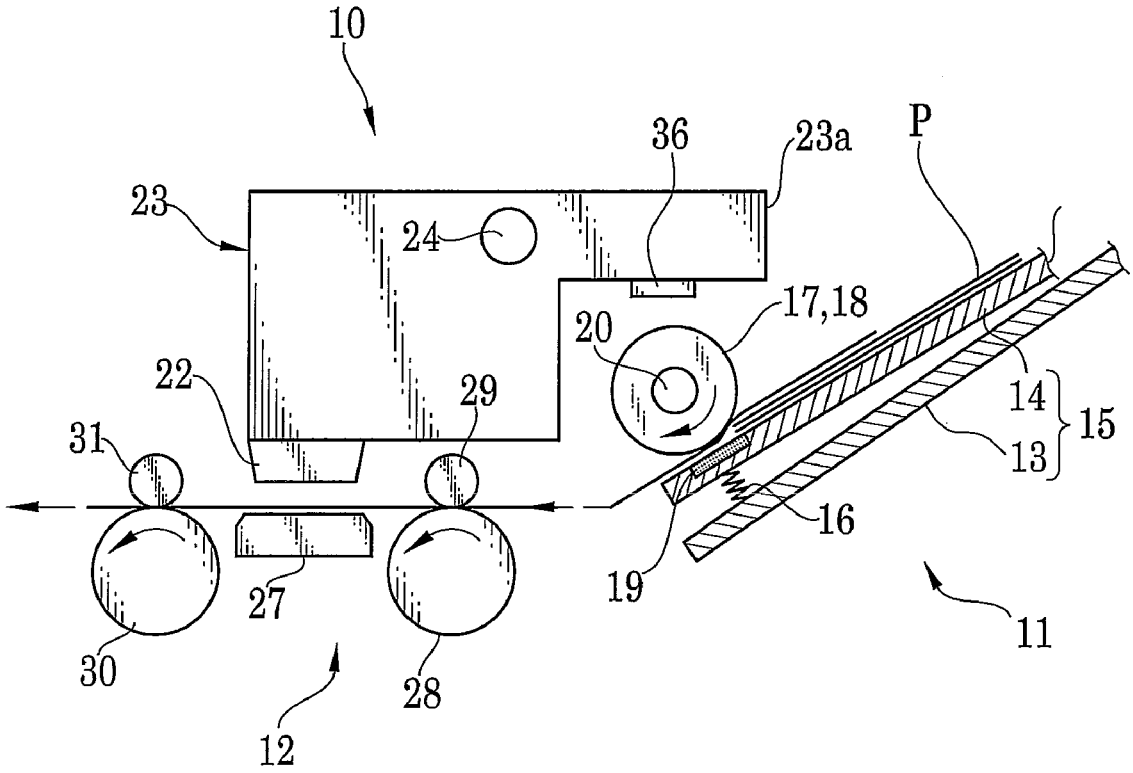
FIG. 1 is a schematic side view of an ink jet printer according to a first embodiment of the present invention.

Referring to FIG. 1, an ink jet recording apparatus (hereinafter, ink jet printer) 10 includes a paper supply section 11 for feeding a sheet-like recording medium (for example, recording paper) P, and a recording section 12 for recording (printing) the recording medium P. The paper supply section 11 is composed of a paper supply tray 15 and two supply rollers 17, 18 (see FIG. 3). The paper supply tray 15 includes a base plate 13 and a pressure plate 14 swingably attached to the base plate 13. The pressure plate 14 holds a stack of recording media P.

The pressure plate 14 is biased to supply rollers 17, 18 by a spring 16 on the base plate 13. Provided to face the supply rollers 17, 18 on the pressure plate 14 is a separation pad (cleaning member) 19 which prevents double-feed of the recording media P and is also used to clean the supply rollers 17, 18.

The supply rollers 17, 18 are made of an elastic material, such as rubber, and fixed to a rotary shaft 20 extending in a main scanning direction (width direction of the recording medium P). The rotary shaft 20 is rotated by a supply roller rotating mechanism 21 (see, FIG. 3) that includes a motor and a gear train. In feeding the recording medium P, the supply roller rotating mechanism 21 rotates the supply rollers 17, 18 to produce a frictional force that draws an uppermost recording medium P on the pressure plate 14, and feed it in a sub scanning direction shown by an arrow to the recording section 12.

The separation pad 19 is made of urethane or the like, and holds the lower one of two overlapping recording media P with a frictional force. Because of the separation pad 19, two overlapping recording media P are not fed together at once to the recording section 12.

The recording section 12 includes an ink jet recording head (hereinafter, recording head) 22 and a carriage 23 that detachably holds the recording head 22. The carriage 23 is placed near the supply rollers 17, 18 above a feeding path of the recording medium P, and upstream from the supply rollers 17, 18 in a feeding direction of the recording medium P. Slidably supported on a guide shaft 24 extending in the main scanning direction, the carriage 23 slides back and forth in the main scanning direction with a driving force of a carriage shift mechanism 25 (see, FIG. 3) which includes a drive belt and a pair of pulleys.

The recording section 12 also includes a platen 27, feed rollers 28, 30 and pinch rollers 29, 31. The platen 27 is disposed below the recording head 22, and supports the recording medium P coming from the paper supply section 11. The feed roller 28 is placed upstream from the platen 27 and below the carriage 23. The feed roller 28 is pressed against by the pinch roller 29. In cooperation with the pinch roller 29, the feed roller 28 feeds the recording medium P onto the platen 27.

The feed roller 30 is placed downstream from the platen 27. The feed roller 30 is pressed against by the pinch roller 31. In cooperation with the pinch roller 31, the feed roller 30 discharges the recording medium P that has been recorded in the recording section 12 onto a paper discharge tray (not shown).

Arriving at the recording section 12 from the paper supply section 11, the recording medium P passes the feed roller 28 to reach the platen 27. On the platen 27, the recording medium P is held between the feed roller 30 and the pinch roller 31, and fed in the sub scanning direction. The carriage 23 moves in the main scanning direction during this feeding, and the recording head 22 ejects droplets of ink to record an image with ink dots on the recording medium P. The carriage 23 is connected to a flexible board (not shown) that transmits record data from a driver 32 (see, FIG. 4) to the recording head 22. Based on the record data, the recording head 22 ejects an ink from ink nozzles.

Figure 2:
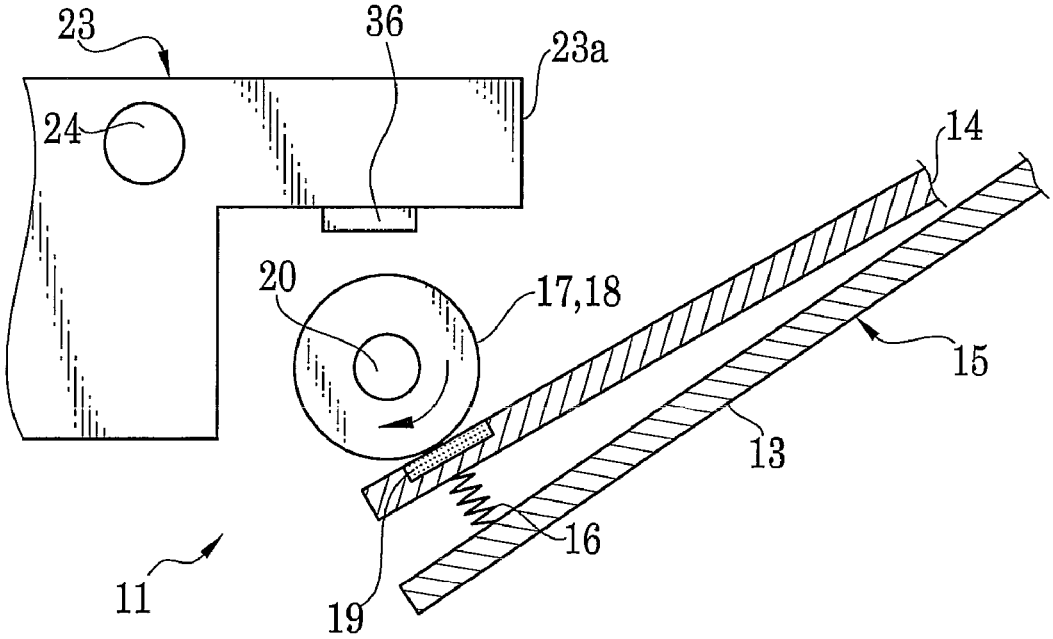
FIG. 2 is an enlarged side view of a supply roller and a separation pad during a cleaning operation.

As shown in FIG. 2, in advance of cleaning, all the recording media P are removed from the pressure plate 14. Released from the weight of the recording media P, the pressure plate 14 is pushed upward by the spring 16 to press onto peripheral surfaces 17*a*, 18*a* of the supply rollers 17, 18. As a command to start a cleaning operation is entered through an operating section 34 (see, FIG. 4), the supply roller rotating mechanism 21 starts a cleaning operation to rotate the supply rollers 17, 18 as being pressed onto the separation pad 19, and remove the dirt, such as powders and dust, from the peripheral surfaces 17*a*, 18*a*.

During the cleaning operation, it is monitored the progress of removal of the dirt from the peripheral surfaces 17*a*, 18*a* of the supply rollers 17, 18. When the dirt is removed completely from the peripheral surfaces 17*a*, 18*a*, the rotation of the supply rollers 17, 18 is stopped to finish the cleaning operation. The progress of cleaning is measured with an optical sensor 36. This optical sensor 36 is attached to the under surface of the projecting part 23*a* of the carriage 23. The projecting part 23*a* is elongated to hang over the supply rollers 17, 18.

Figure 3:
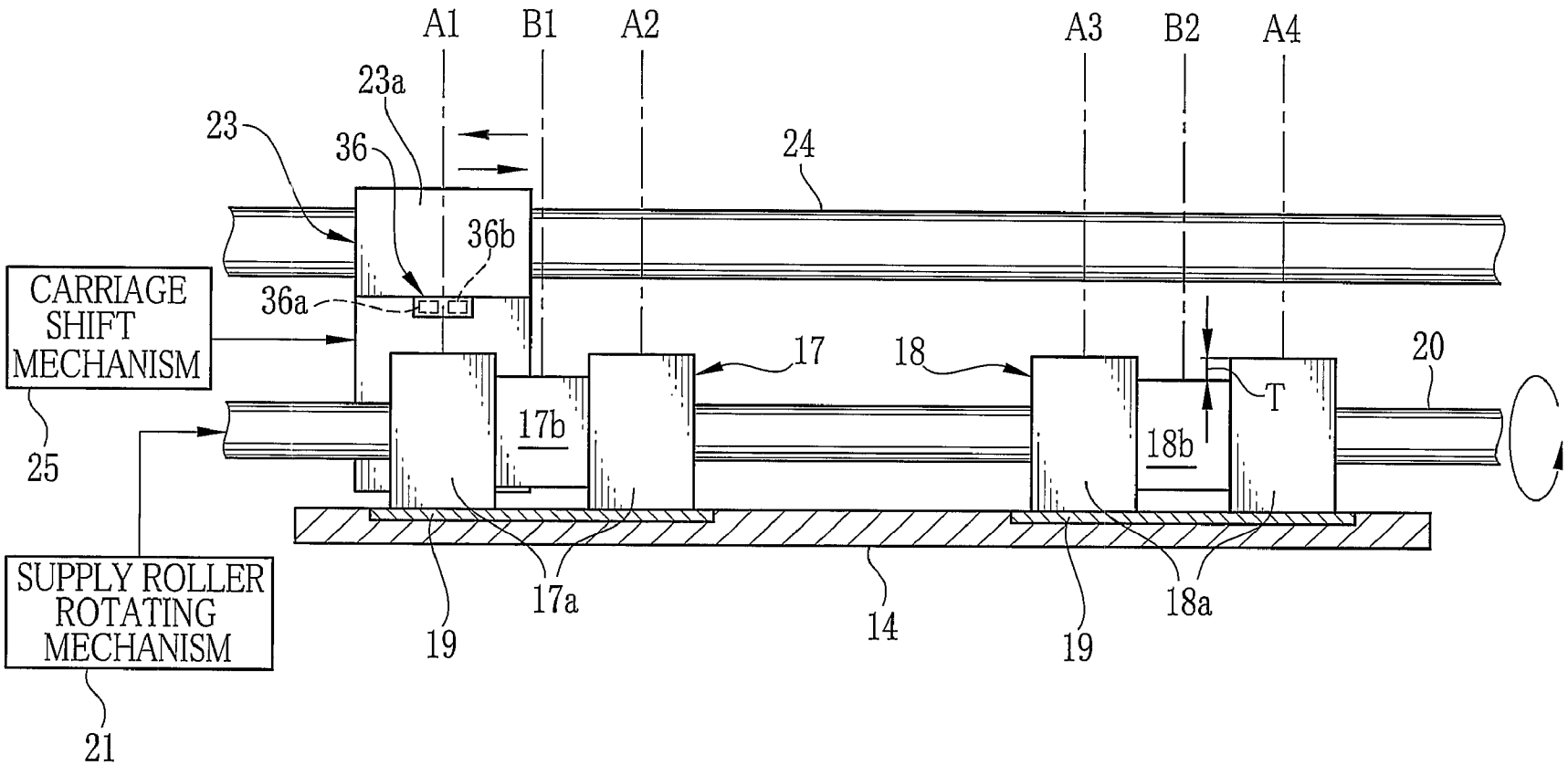
FIG. 3 is a front view of the supply roller and a recording head, as viewed from an upstream side in a feeding direction of a recording medium.

As shown in FIG. 3, the optical sensor 36 has a light emitter 36*a* and a light receiver 36*b*. The light emitter 36*a* moves with the carriage 23 to above the supply rollers 17, 18, and irradiates inspection light to the supply rollers 17, 18. The inspection light is reflected off the peripheral surfaces 17*a*, 18*a* of the supply rollers 17, 18, and enters the light receiver 36*b*.

The light receiver 36*b* converts the incident light into an output signal (voltage signal V) proportional to the intensity of the light. For example, with the presence of dirt, the peripheral surfaces 17*a*, 18*a* of the supply rollers 17, 18 scatter the inspection light to lower the intensity of the reflected light, and lead to decrease the level of output signals. If the peripheral surfaces 17*a*, 18*a* are cleaned up, on the contrary, the reflected light has high intensity, which increases the level of output signals. In short, the output level of the optical sensor 36 gradually increases as the dirt is removed more effectively from the peripheral surfaces 17*a*, 18*a*. This means that the progress of cleaning is checked by measuring the amount of dirt on the peripheral surfaces 17*a*, 18*a* of the supply rollers 17, 18 using the output level of the optical sensor 36.

In measuring the dirt on the peripheral surfaces 17*a*, 18*a* of the supply rollers 17, 18, the carriage 23 is moved in the main scanning direction so as to locate the optical sensor 36 to the positions corresponding to the supply rollers 17, 18 (above the supply rollers 17, 18). This configuration eliminates the need of providing more than one optical sensor 36. Also eliminating the need to provide an additional mechanism to move the optical sensor 36 in the main scanning direction, this configuration allows producing the ink jet printer 10 at low cost. When the optical sensor 36 is moved above the supply rollers 17, 18 along with the carriage 23, the projecting part 23*a* hangs over the supply rollers 17, 18, and blocks light out of a ceiling lamp from entering the optical sensor 36. This improves accuracy of the measurement.

Since the optical sensor 36 measures the amount of dirt while the supply rollers 17, 18 are rotating, a plurality of measurement results for at least one rotation of the supply rollers 17, 18 are obtained at every measurement position in the main scanning direction. Consequently, the highest one of these output signals of the optical sensor 36 is identified as an output level. For certain, it is possible to use an averaged signal level or an integrated signal level as the output level. Alternatively, the signals may be sampled at regular periods so as to measure the peripheral surfaces of the supply rollers 17, 18 at constant pitches. In this case, plural output levels are obtained at every measurement position in the main scanning direction. In the event that the output levels are compared between current and previous measurements to check the progress of deterioration of the supply roller, the output levels may be the maximum ones of the plural output levels.

In measuring the dirt on the peripheral surfaces 17*a*, 18*a* of the supply rollers 17, 18 during the cleaning operation, the output level of optical sensor 36 varies depending not only on the dirt, but also on the material, color, and temporal change (including shape deformation) of the supply rollers 17, 18. It is therefore difficult to make an accurate judgment on whether or not the dirt is removed from the peripheral surfaces 17*a*, 18*a*, only by measuring the intensity of the reflected light off the peripheral surfaces 17*a*, 18*a* of the supply rollers 17, 18.

In view of this, the supply rollers 17, 18 in this embodiment have annular grooves 17*b*, 18*b* which extend along a circumferential in the middle of a roller width direction. Each of the annular grooves 17*b*, 18*b* has a depth (step) T of, for example, 1 mm or more, such that the recording medium P does not touch the groove floor even when the supply rollers 17, 18 deform elastically. Because of the depth T, the annular grooves 17*b*, 18*b* are free of dirt. It is therefore possible to measure the degree of dirt of the supply rollers 17, 18 accurately by comparing the peripheral surfaces 17*a*, 18*a* to the floors of the annular grooves 17*b*, 18*b*.

In this embodiment, the optical sensor 36 calculates the difference between the output levels for the dirt (second dirt) on the floors of the annular grooves 17*b*, 18*b* and the output levels for the dirt (first dirt) on two regions (separated by the annular grooves 17*b*, 18*b*) of the peripheral surfaces 17*a*, 18*a*. Hereafter, the region of the peripheral surface 17*a* closer to the supply roller 18 is referred to as an inner peripheral surface, while the other region is referred to as an outer peripheral surface. Similarly, the region of the peripheral surface 18*a* closer to the supply roller 17 is referred to as an inner peripheral surface, while the other region is referred to as an outer peripheral surface.

First of all, the optical sensor 36 is moved in the main scanning direction to get to a measurement position A1 above the outer peripheral surface of the supply roller 17, a position B1 above the floor of the annular groove 17*b*, and a measurement position A2 above the inner peripheral surface of the supply roller 17 sequentially, and measures the amount of dirt on the supply roller 17 at the two measurement positions A1, A2. Then, the optical sensor 36 calculates the difference between the output level indicating the amount of dirt on the floor of the annular groove 17*b* and the output levels indicating the amount of dirt on the peripheral surface 17*a* (inner and outer peripheral surfaces). When there is little difference between the output levels, it is judged that the peripheral surface 17*a* is as clean as the floor of the annular groove 17*b*, and that the dirt is removed. When there is much difference between the output levels, on the contrary, it is judged that dirt accumulates.

Subsequently, the optical sensor 36 is moved in the main scanning direction to get to a measurement position A3 above the inner peripheral surface of the supply roller 18, a position B2 above the floor of the annular groove 18*b*, and a measurement position A4 above the outer peripheral surface of the supply roller 18 sequentially, and measures the amount of dirt on the supply roller 18 at each measurement position. Based on the difference between the output level indicating the amount of dirt on the floor of the annular groove 18*b* and the output levels indicating the amount of dirt on the peripheral surface 18*a*, it is judged whether or not the dirt is removed at the measurement positions A3 and A4.

This dirt measurement on the peripheral surfaces 17*a*, 18*a* of the supply rollers 17, 18 and the subsequent judgment on removal of the dirt are performed every time the supply rollers 17, 18 rotate a predetermined number of times (for example, two rotations).

Figure 4:
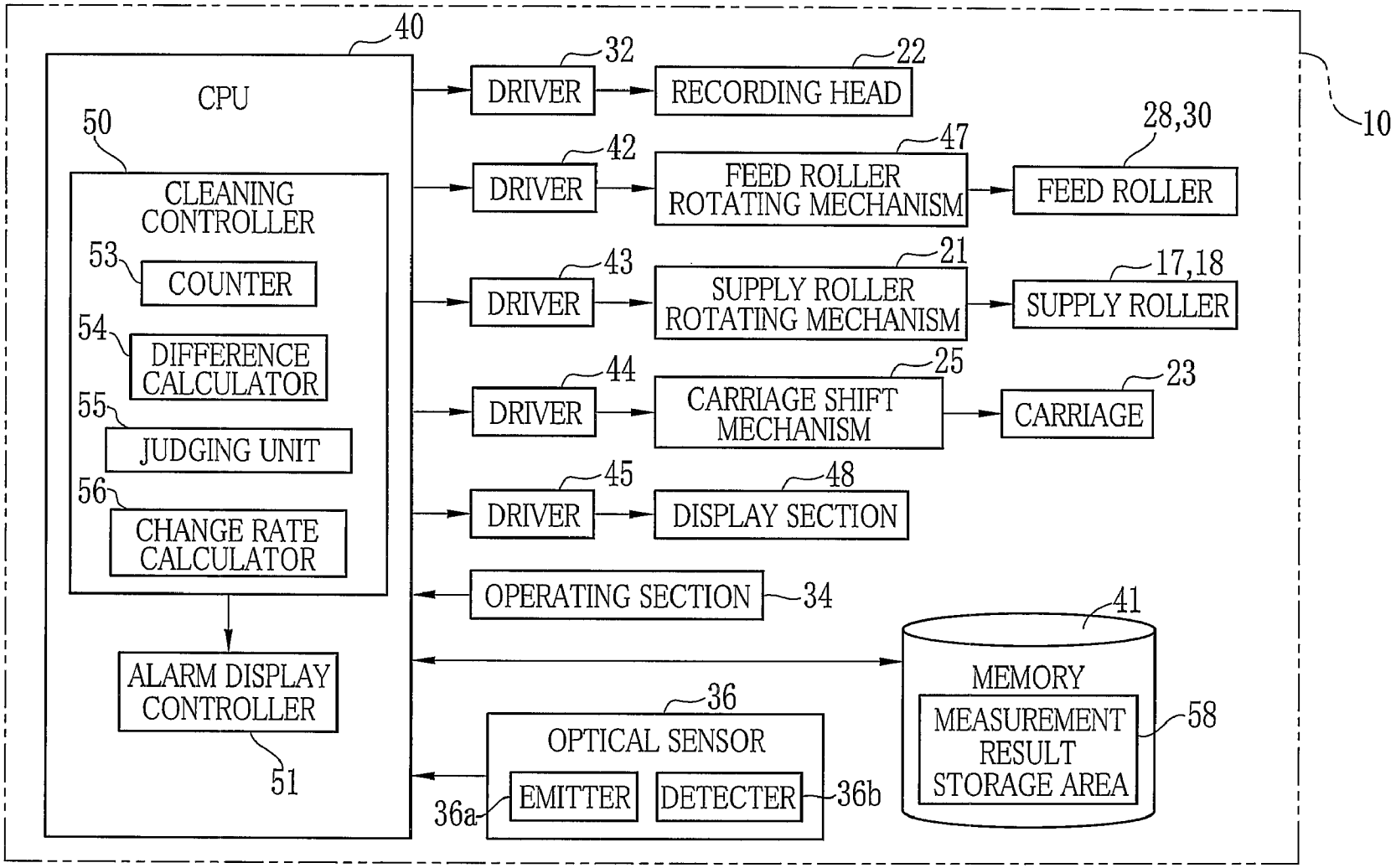
FIG. 4 is an electrical block diagram of the ink jet printer.

As shown in FIG. 4, the CPU 40 controls entire operation of the ink jet printer 10. The CPU 40 is connected to the driver 32, the operating section 34, the optical sensor 36, and also to a memory 41, and several drivers 42-45. The memory 41 stores a control program and information, which the CPU 40 runs to operate the ink jet printer 10.

The driver 42 is coupled to a feed roller rotating mechanism 47 which rotates the feed rollers 28, 30. The feed roller rotating mechanism 47 includes a motor and a gear train. Responding to a control signal from the CPU 40, the driver 42 drives the feed roller rotating mechanism 47 to rotate and stop the feed rollers 28, 30.

The driver 43 is coupled to the supply roller rotating mechanism 21. The driver 43 follows a control signal from the CPU 40, and drives the supply roller rotating mechanism 21 to rotate and stop the supply rollers 17, 18. The driver 44 is coupled to the carriage shift mechanism 25. The driver 44 follows a control signal from the CPU 40, and drives the carriage shift mechanism 25 to move the carriage 23 in the main scanning direction.

The driver 45 is coupled to a display section 48 including a liquid crystal display device. The display section 48 displays different types of information, such as an operating state of the ink jet printer 10 and alarm messages. The driver 45 controls the display section 48 according to a control signal from the CPU 40.

The CPU 40 is also connected to an input interface (not shown) to receive image data entered from outside. This image data is stored in the memory 41. Upon receiving a print start command entered through the operating section 34, the CPU 40 carries out an image recording operation to the recording medium P by controlling the drivers 42-44 to move the feed rollers 28, 30, the supply rollers 17, 18 and a carriage 23, and by retrieving the image data from the memory 41 and sending it to the recording head 22 by way of the driver 32.

The CPU 40 serves not only as a recording controller to perform the image recording operation, but also as a cleaning controller 50 to perform the aforesaid cleaning operation, and an alarm display controller 51 to control the operation to display an alarm message. The cleaning controller 50 includes a counter 53, a difference calculator 54, a judging unit 55 and a change rate calculator 56.

The counter 53 counts the number of rotations of the supply rollers 17, 18 during the cleaning operation. The counter 53 increments the count of rotations by one every time the supply rollers 17, 18 make one rotation. Upon finish of the cleaning operation, the counter 53 resets the counted value. The cleaning controller 50 reads the counted value on the counter 53, and starts measuring dirt on the supply rollers 17, 18 with the optical sensor 36 every time the supply rollers 17, 18 rotate a predetermined number of times.

The cleaning controller 50 drives the carriage shift mechanism through the driver 44, during the cleaning operation, to move the optical sensor 36 to each of the positions A1, B1, A2, A3, B2 and A4 in turn, and operates the optical sensor 36 to measure the dirt on these positions. The output levels of the optical sensor 36 are transmitted in sequence to the CPU 40.

The difference calculator 54 calculates differences between the output level indicating the amount of dirt on the floor of annular groove 17*b* of the supply roller 17 and the output levels indicating the amount of dirt on each of the inner and outer peripheral surfaces. These differences are transmitted as output level differences on the supply roller 17, from the difference calculator 54 to the judging unit 55 and the memory 41. In the same manner, the difference calculator 54 calculates the differences on the supply roller 18. The memory 41 stores the output level differences into a measurement result storage area 58 sequentially.

The judging unit 55 makes a judgment on whether or not each of the output level differences, transmitted from the difference calculator 54, falls below a predetermined threshold value Th (see, FIG. 5) established for each of the measurement positions on the supply rollers 17, 18. When all the output level differences on the supply rollers 17, 18 fall below the threshold value Th, the supply rollers 17, 18 are judged as being cleaned out. When any of the output level differences is at or above the threshold value Th, on the contrary, the supply rollers 17, 18 are judged as being not yet cleaned out.

Figure 5:
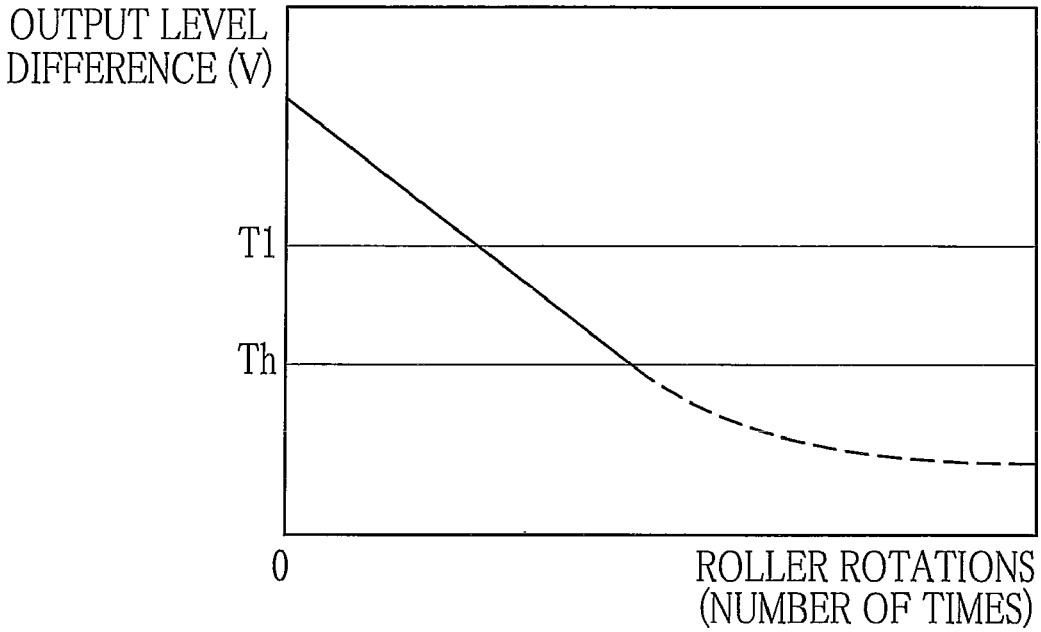
FIG. 5 is a graph of number of rotations of the supply roller versus output level difference that represents a result of cleaning.

As shown in FIG. 5, as the number of rotations of the supply rollers 17, 18 increases in the cleaning operation, the output level differences on the supply rollers 17, 18 go down to the threshold value Th, and at a certain point in time fall below the threshold value Th. The cleaning controller 50 continues the cleaning operation until the output level differences fall below the threshold value Th in all the measurement positions.

The threshold value Th is set below a threshold value T1 which ensures a normal image recording (printing) operation free from jamming and other feeding errors. Using the threshold value Th at this level leads to postpone another cleaning operation, which otherwise has to be done shortly thereafter due to the dirt that starts accumulating right after the previous cleaning operation.

Figure 6:
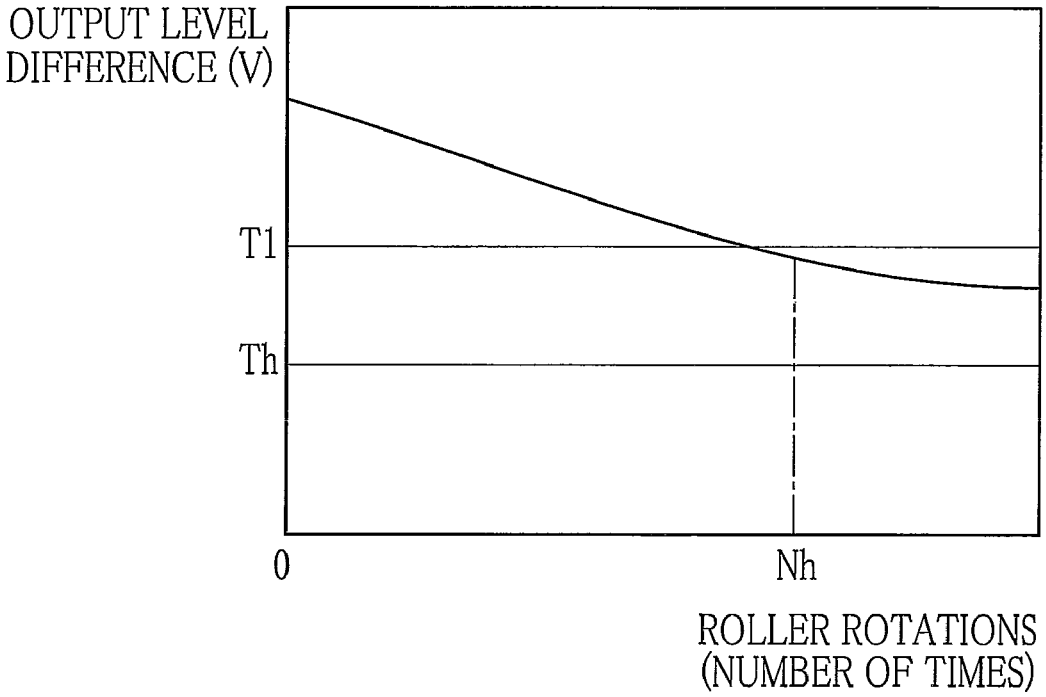
FIG. 6 is a graph similar to FIG. 5, but for a considerably deteriorated supply roller.

When the dirt is too much to remove effectively, the supply rollers 17, 18 have significantly deteriorated and need to be replaced. In this instance, the output level difference may not fall below the threshold value Th, as shown in FIG. 6, no matter how many times the supply rollers 17, 18 are rotated. In view of this, when the counter 53 counts up to a predetermined number of rotations Nh (for example, 10 rotations), the cleaning controller 50 terminates the cleaning operation, and enters information promoting replacement of the supply roller into the alarm display controller 51.

The change rate calculator 56 calculates rates of change in the output level differences on supply rollers 17, 18 between the previous ones (hereinafter, previous output level differences) and the current one (hereinafter, current output level differences), every time the output level differences on supply rollers 17, 18 are calculated during a single cleaning operation. The previous output level differences are retrieved from the measurement result storage area 58 in the memory 41. These change rates, calculated by the change rate calculator 56, are used to determine the progress of deterioration of the supply rollers 17, 18.

Figure 7:
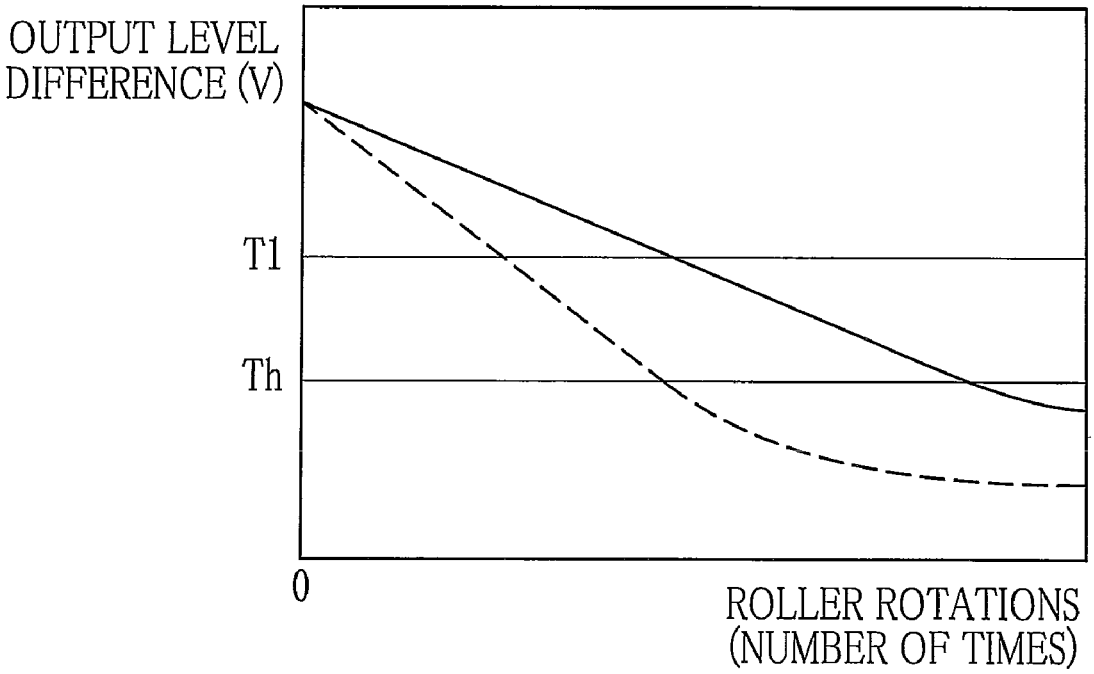
FIG. 7 is a graph similar to FIG. 5, showing a relationship of deterioration degree of the supply roller versus result of cleaning.

As shown in FIG. 7, when the supply rollers 17, 18 have deteriorated to a certain extent, but not need to be replaced, the supply rollers 17, 18 are rotated more times (shown by a solid line) to bring the output level difference below the threshold value Th than when they do not deteriorate (shown by a dashed line) This means that the change rate decreases as the supply rollers 17, 18 are deteriorating. In view of this, when the change rate calculated by the change rate calculator 56 is below a predetermined reference change rate, the cleaning controller 50 enters information about the deterioration of the supply roller into the alarm display controller 51. The reference change rate may be a change rate at the time of printer installation (or before shipment). In addition, the change rate for this purpose may be calculated only in the measurement position A1.

Referring back to FIG. 4, the alarm display controller 51 operates the display section 48 through the driver 45 to display a roller replacement alarm message, such as "Please replace the supply rollers", upon receiving the information indicating that the counter 53 has counted up to the predetermined number of rotations Nh in the cleaning operation. Also, the alarm display controller 51 operates the display section 48 to display a roller deterioration alarm message, such as "Supply rollers have deteriorated", upon receiving the information indicating that the calculated change rate is below the reference change rate.

Next, the operation of the ink jet printer 10 thus configured is explained. The present invention, however, is not directly related to an image recording (printing) process of the ink jet printer 10, and thus the cleaning operation is only explained hereafter. In advance of the cleaning operation, the recording media P are removed from the pressure plate 14. The pressure plate 14 moves and presses on the peripheral surfaces 17*a*, 18*a* of the supply rollers 17, 18.

Receiving a cleaning command from the operating section 34, the cleaning controller 50 in the CPU 40 drives the supply roller rotating mechanism 21 through the driver 43 to rotate the supply rollers 17, 18 in contact with the separation pad 19. During the cleaning operation, the counter 53 of the cleaning controller 50 counts the number of rotations of the supply rollers 17, 18.

Reading the counted value on the counter 53, the cleaning controller 50 operates the carriage shift mechanism 25 and the optical sensor 36, every time the supply rollers 17, 18 rotate a predetermined number of times, and measures dirt in each position (see, FIG. 3) of the supply rollers 17, 18 sequentially with the optical sensor 36. The CPU 40 enters the output levels of the optical sensor 36 into the difference calculator 54.

The difference calculator 54 calculates the differences between the output value obtained in the measurement on the floor of the annular groove 17*b* of the supply roller 17 and the output levels obtained in the measurement on the peripheral surface 17*a* (inner and outer peripheral surfaces), as the output level differences on the supply roller 17. In the same manner, the difference calculator 54 calculates the output level differences on the supply roller 18. These output level differences are transmitted to the judging unit 55 and the memory 41. In the memory 41, the output level differences are stored to the measurement result storage area 58.

The judging unit 55 judges on whether or not the dirt has been removed from the supply rollers 17, 18, based on whether each of the output level differences on the supply rollers 17, 18 falls below the threshold value Th. When the dirt is judged as being removed from both the supply rollers 17, 18, the cleaning controller 50 stops the operation of the supply roller rotating mechanism 21 to stop the rotation of the supply rollers 17, 18, and finishes the cleaning operation. In this manner, the cleaning operation lasts until the dirt is judged as being removed. It is therefore possible to rotate the supply rollers 17, 18 only the minimum number of times to remove the dirt. This prevents excessive rotation of the supply roller when the supply rollers 17, 18 are not very dirty, and prevents the termination of the cleaning operation when the supply rollers 17, 18 are dirty.

The cleaning controller 50 keeps rotating the supply rollers 17, 18 while at least one of them is judged as still having the deposited dirt. The cleaning controller 50 reads the counted value on the counter 53, and starts measuring the dirt again when the supply rollers 17, 18 have rotated the predetermined number of times after the previous dirt measurement. The difference calculator 54 calculates current output level differences on the supply rollers 17, 18, and transmits them to the judging unit 55 and the memory 41.

At the same time, the change rate calculator 56 calculates a change rate between the current (second measurement) and previous (first measurement) output level differences. When the calculated change rate is below the reference change rate, the cleaning controller 50 enters the alarm information into the alarm display controller 51. In response, the alarm display controller 51 operates the display section 48 through the driver 45 to display the roller deterioration alarm message, which encourages replacement of the supply roller.

The judging unit 55 judges on whether or not the dirt has been removed from the supply rollers 17, 18, based on the newly-entered current output level differences. When the dirt is judged as being removed, the cleaning controller 50 finishes the cleaning operation. When the dirt is judged as not being removed, on the contrary, the cleaning controller 50 repeats the aforesaid steps until the dirt is judged as being removed from both supply rollers 17, 18.

In the event that the counted value on the counter 53 reaches the predetermined number of rotations Nh during this series of steps, the cleaning controller 50 terminates the cleaning operation, and enters the alarm information into the alarm display controller 51. In response, the alarm display controller 51 operates the display section 48 to display the roller replacement alarm message.

Although this first embodiment is directed to use the output level differences on the supply rollers 17, 18, it is possible to use only the output levels indicating the amount of dirt on the peripheral surfaces 17*a*, 18*a*.

Figure 9:
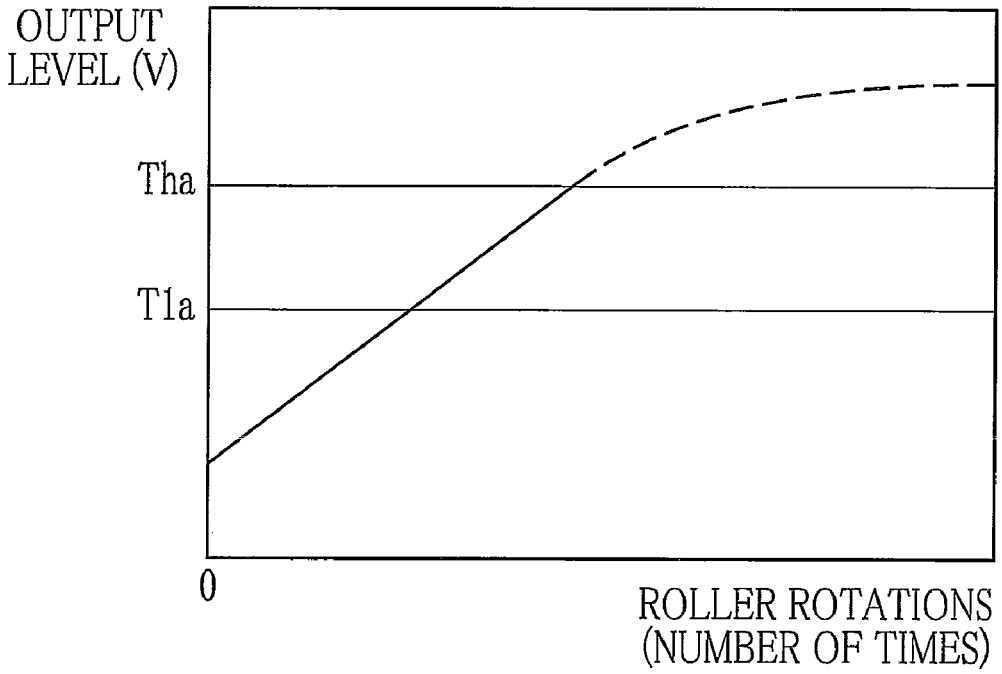
FIG. 9 is a graph of number of rotations of the supply roller versus dirt.
Figure 8:
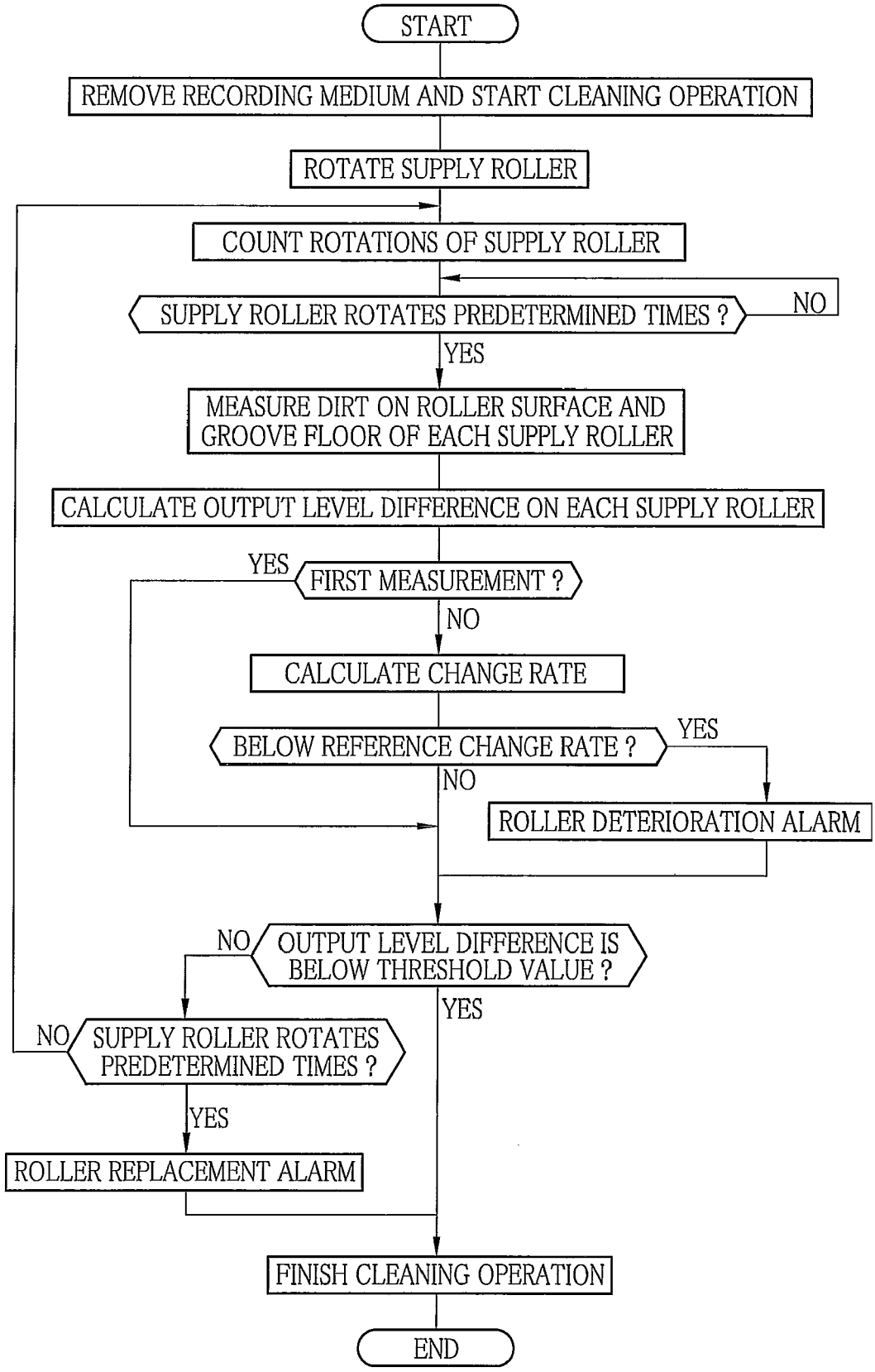
FIG. 8 is a flow chart of a supply roller cleaning operation.

In this case, as shown in FIG. 9, the output level of the optical sensor 36 increases to a threshold value Tha as the number of rotations of the supply rollers 17, 18 increases, and at a certain point in time it exceeds the threshold value Tha. The cleaning operation is therefore continued until the output level of the optical sensor 36 is judged to exceed the threshold value Tha. The threshold value Tha is set above a threshold value T1*a* which ensures a normal image recording (printing) operation free from jamming and other feeding errors. In this case, there is no need to provide the annular grooves 17*b*, 18*b*.

It is also possible in this case to measure only one of the peripheral surfaces 17*a*, 18*a* of the supply rollers 17, 18. This eliminates the measuring process on the other one of the supply rollers 17, 18, and reduces the total measurement time.

In the first embodiment, the annular grooves 17*b*, 18*b* are measured every time in measuring the amount of dirt on the supply rollers 17, 18. The amount of dirt in the annular grooves 17*b*, 18*b*, however, will stay about the same. Therefore, it is preferred to measure the dirt in the annular grooves 17*b*, 18*b* only once in the first dirt measurement, and store this measurement result (output levels) in the measurement result storage area 58. This eliminates the need of regular measurement on the annular grooves 17*b*, 18*b*, and reduces the total measurement time.

Although in the first embodiment the supply rollers 17, 18 are both measured every time in the cleaning operation, only one of them needs be measured in the second and subsequent measurements. For example, a dirtier one of the supply rollers 17, 18 is identified in the first dirt measurement, and only the dirtier one is measured in the second and subsequent measurements. This also reduces the total measurement time.

It is possible to measure only one of the outer peripheral surfaces (the measurement positions A1, A4) and only one of the inner peripheral surfaces (the measurement positions A2, A3) of the supply rollers 17, 18. Since the outer peripheral surfaces of the supply rollers 17, 18 are arranged symmetrically about the center in the main scanning direction of the rotary shaft 20 (and so are the inner peripheral surfaces), they apply the same pressing force to the recording medium P, and thus would have almost the same amount of dirt. Therefore, measuring one outer peripheral surface and one inner peripheral surface of the supply rollers 17, 18 eliminates the need of measuring the other peripheral surfaces. This serves to reduce the total measurement time.

While the separation pad 19 is used as a cleaning member, a separate cleaning member may be provided on the pressure plate 14. Further, the dirt measuring sensor is not limited to an optical sensor, but can be any type of sensor.

Figure 10:
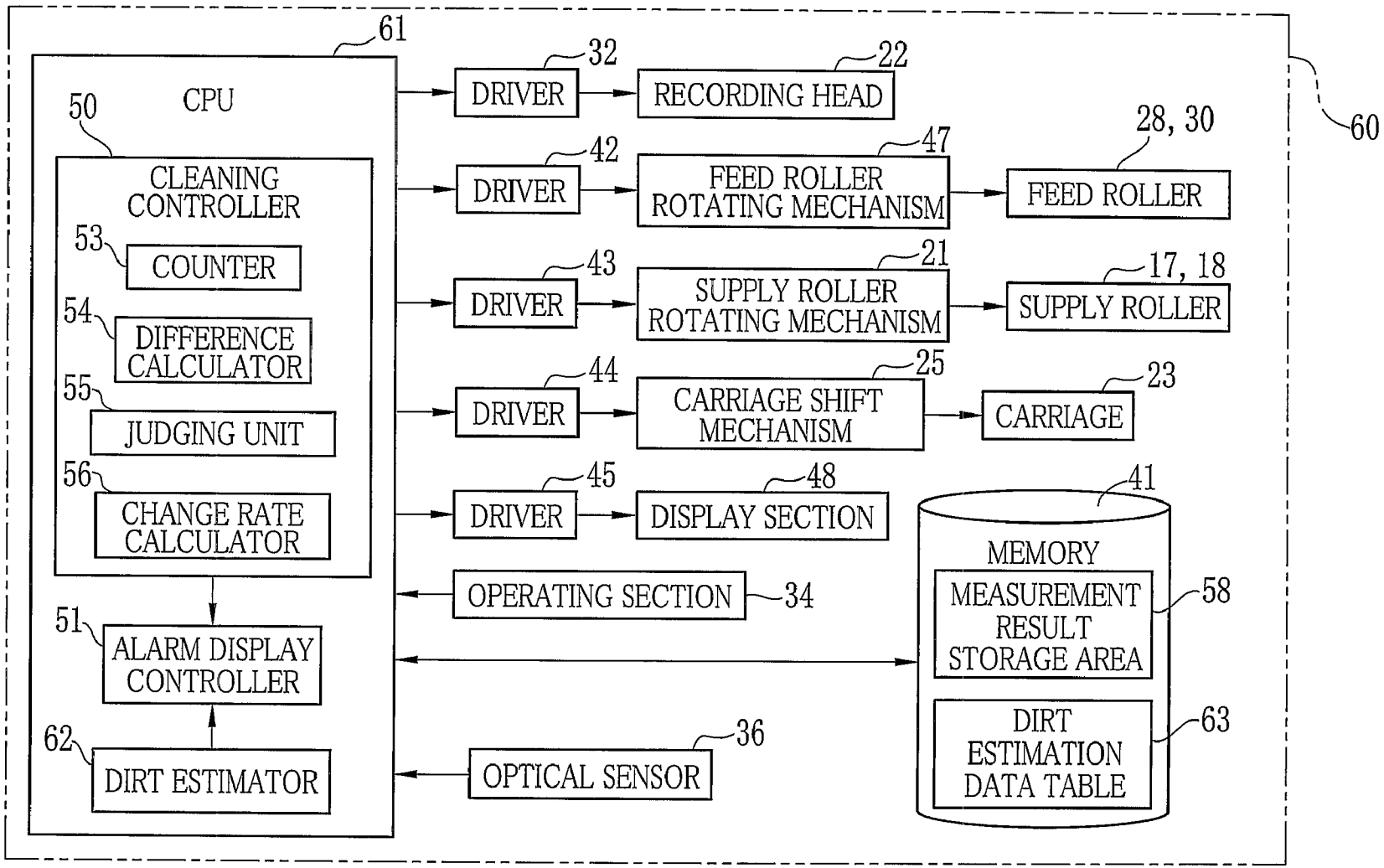
FIG. 10 is an electrical block diagram of an ink jet printer according to a second embodiment of the present invention.

Next, with reference to FIG. 10, a second embodiment of the present invention is explained. An ink jet printer 60 uses the measurement result of the optical sensor 36 to estimate the amount of dirt the supply rollers 17, 18 will have during so-called serial printing to print (record) a plurality of the recording media P serially, before starting a serial printing operation. Particularly, dirt on the supply rollers 17, 18 is estimated based on the measurement result of the optical sensor 36, the type of recording media P, and the number of prints to be made in the serial printing. The type of the recording medium P should be considered because different types of recording media P produce different amount of powders to attach the supply rollers 17, 18 during the feeding operation, changing the amount of dirt.

In FIG. 10, the ink jet printer 60 is basically the same in configuration as the ink jet printer 10 of the first embodiment. Hereafter, elements similar to those in the first embodiment are designated by the same reference numerals, and detailed explanations thereof are omitted. A CPU 61 of the ink jet printer 60 has a dirt estimator 62 in addition to the cleaning controller 50 and the alarm display controller 51, and the memory 41 has a dirt estimation data table 63. The operating section 34 is used to enter the recording media type and the number of prints.

The dirt estimator 62 refers to the dirt estimation data table 63 (see, also FIG. 11), and estimates the amount of dirt on the supply rollers 17, 18 at the end of serial printing (see, FIG. 12), based on the measurement result (output levels of the optical sensor 36) on the supply rollers 17, 18, the recording media type and the number of prints entered through the operating section 34.

The cleaning controller 50, upon receiving the information about the recording media type and the number of prints from the operating section 34, operates the carriage shift mechanism 25 and the optical sensor 36 in the aforesaid manner to measure the amount of dirt on the supply rollers 17, 18. For the sake of simplicity, the annular grooves 17*b*, 18*b* are not measured in this second embodiment. The optical sensor 36 enters its output levels at each of the measurement positions in the main scanning direction sequentially into the CPU 61. The CPU 61 transmits these output levels to the dirt estimator 62. The dirt estimator 62 compares these output levels, and estimates the amount of dirt using the lowest output level Ti (which represents the maximum amount of dirt).

Figures 11, 12:
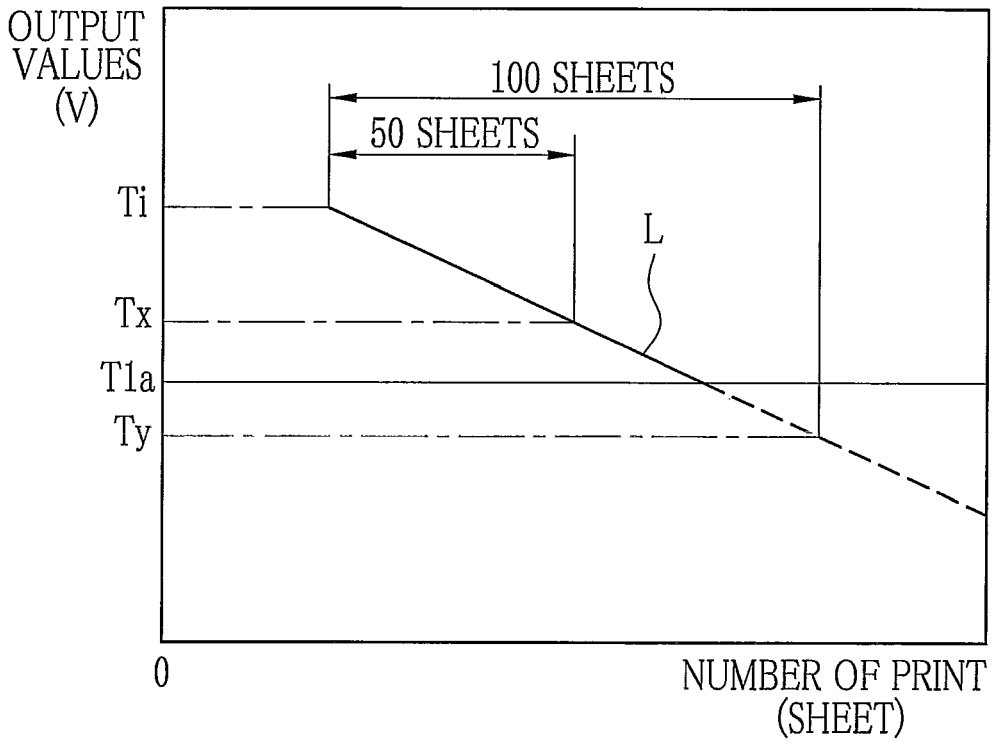
FIG. 11 is an explanatory view of an example of a dirt estimation data table.
FIG. 12 is a graph of number of serial prints versus dirt on the supply roller.

As shown in FIG. 11, the dirt estimation data table 63 contains a list of output decrease data which shows a decreased amount in output level of the optical sensor 36 during the feeding of a single recording medium P with the supply rollers 17, 18, for each type of the recording media P. The output decrease data may be prepared through experiments. The output decrease data allows estimating how much the output level of the optical sensor 36 will decrease when a certain number of sheets (for example, 50 sheets) have been printed, according to the type of the recording medium P. The dirt estimator 62 gains access to the dirt estimation data table 63, and retrieves output decrease data corresponding to the type of a recording medium P to be printed.

As shown in FIG. 12, the dirt estimator 62 determines the relationship between the number of prints and the output level of the optical sensor 36, based on the output level Ti and the output decrease data retrieved from the dirt estimation data table 63. This relationship is represented by a downward-sloping line L in FIG. 12. This downward-sloping line L originates from the output level Ti, and has a slope corresponding to the output decrease data. With the downward-sloping line L, it can be estimated how much the output level of the optical sensor 36 will decrease from the current output level Ti, according to the number of the recording media P to be printed serially. This estimation leads to determine whether or not the output level of the optical sensor 36 falls below the threshold value T1*a* at the end of the serial printing.

For example, upon serially printing 50 sheets of the type "A" recording media P whose output decrease data is "Va", the output level of the optical sensor 36 will decrease by Tx (=Ti−50×Va) from Ti. Since this output level Tx is higher than the threshold value T1*a*, the cleaning operation is not necessary even after the serial printing for 50 sheets. Upon serially printing 100 sheets, the output level of the optical sensor 36 will decrease by Ty (=Ti−100×Va) from Ti. This output level Ty is lower than the threshold value T1*a*, and thus the output level of the optical sensor 36 falls below the threshold value T1*a* in the middle of the serial printing. Here, the downward-sloping line L has a linear slope in FIG. 12, but it may have a nonlinear slope insofar as it can serve to estimate the decrease of the output level.

Figure 13:
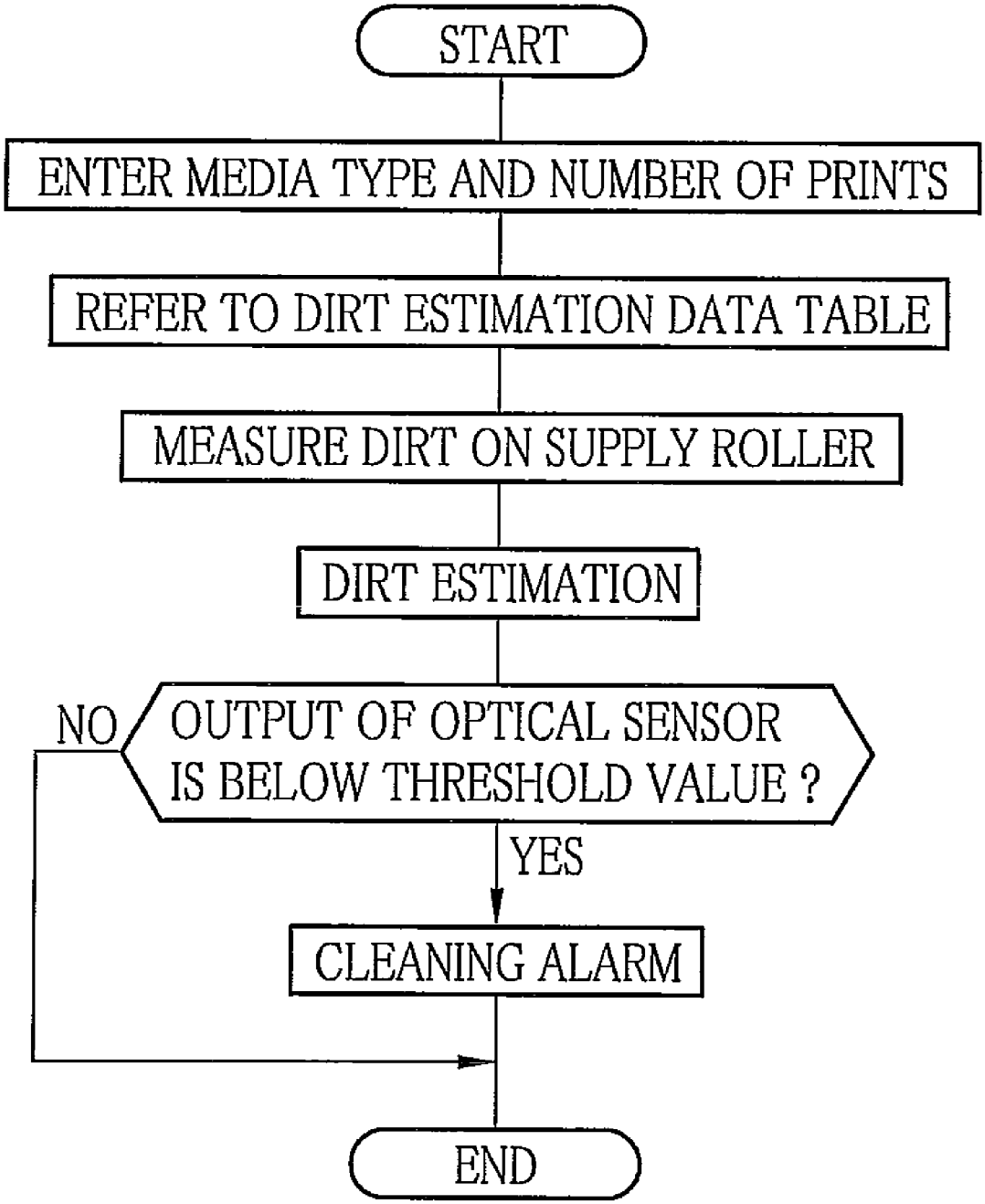
FIG. 13 is a flow chart of a dirt estimation process to estimate the dirt that the supply roller has at the end of serial printing.

Next, with reference to FIG. 13, the operation of the ink jet printer 60 is explained. In advance of the serial printing operation, the type of recording media P and the number of prints are entered through the operating section 34. The dirt estimator 62 retrieves the output decrease data for the entered type of recording medium P from the dirt estimation data table 63. At the same time, the cleaning controller 50 starts measuring the amount of dirt on the supply rollers 17, 18. The optical sensor 36 enters its output levels, which is the measurement results, into the CPU 61. From these output levels currently entered into the CPU 61, the dirt estimator 62 selects the lowest output level Ti. This lowest value represents the maximum amount of dirt on the supply rollers.

The dirt estimator 62 estimates how much the output level of the optical sensor 36 will decrease from the current output level Ti at the end of the serial printing for the specified number of prints, based on the output level Ti and the output decrease data retrieved from the dirt estimation data table 63.

When estimating that the output level will fall below the threshold value T1*a* at the end of the serial printing, the dirt estimator 62 enters information to encourage cleaning into the alarm display controller 51. In response, the alarm display controller 51 operates the display section 48 to display a cleaning alarm message, such as "Cleaning operation is necessary".

Upon confirming that no alarm message is displayed, a user enters a command to start the serial printing through the operating section 34. Alternatively, the serial printing may be started automatically. When the cleaning alarm message is displayed, on the contrary, a user selects the cleaning operation through the operating section 34 before starting the serial printing.

If the annular grooves 17*b*, 18*b* of the supply rollers 17, 18 are also measured as with the first embodiment, the amount of dirt may be estimated using the largest output level difference (which represents the maximum amount of dirt). In this case, the cleaning alarm massage may be displayed as the output level difference is estimated to fall below the threshold value Ti (see, FIG. 5).

The optical sensor 36 can be provided on any other place than the carriage, insofar as it can measure the dirt on the supply rollers 17, 18.

While two of the supply rollers 17, 18 are provided on the rotary shaft 20 in the above embodiments, one or more than two supply rollers may be provided.

The cleaning alarm and the roller replacement alarm can be audio, and be given through a speaker. When the ink jet printer is connected to a personal computer (PC), these alarms may be displayed on the PC monitor.

While the above embodiments are directed to an ink jet printer, the present invention is also applicable to ink jet copiers, ink jet fax machines and the like. The present invention is not only applicable to the ink jet recording apparatus, but also to thermal printers and such image recording apparatus.

Although the present invention has been fully described by the way of the preferred embodiments thereof with reference to the accompanying drawings, various changes and modifications will be apparent to those having skill in this field. Therefore, unless otherwise these changes and modifications depart from the scope of the present invention, they should be construed as included therein.

What is claimed is:

1. An image recording apparatus for recording an image on a sheet-like recording medium using a recording head located to a recording position, comprising:

a supply roller for feeding said recording medium to said recording position;

a cleaning member for removing dirt from a peripheral surface of said supply roller;

a carriage holding said recording head, and moving back and forth in a main scanning direction orthogonal to a feeding direction of said recording medium;

a dirt measuring sensor attached to said carriage, and for measuring dirt on said peripheral surface of said supply roller; and a cleaning controller for rotating said supply roller as being pressed onto said cleaning member and monitoring said dirt with said dirt measuring sensor during a cleaning operation, and for stopping said supply roller to finish said cleaning operation when said dirt is removed.

2. The image recording apparatus of claim 1 further comprising a pressure plate for holding a stack of recording media, and for pressing the uppermost recording medium onto said supply roller, wherein said cleaning member is attached to said pressure plate.

3. The image recording apparatus of claim 2, wherein said carriage includes a projecting part which hangs over said supply roller, and said dirt measuring sensor is attached to an under surface of said projecting part.

4. The image recording apparatus of claim 3, wherein said recording head is an ink jet recording head which ejects droplets of ink to said recording medium.

5. The image recording apparatus of claim 1 further comprising an annular groove extending in a circumferential direction on said peripheral surface of said supply roller, wherein said dirt measuring sensor measures first dirt on said peripheral surface and second dirt on a floor of said annular groove while said carriage moves in said main scanning direction, and wherein said cleaning controller compares said first dirt with said second dirt to judge whether or not said dirt of said supply roller is removed.

6. The image recording apparatus of claim 1, further comprising:

a roller rotation counter for counting the number of rotations of said supply roller during said cleaning operation; and a first notification device for notifying that said supply roller needs to be replaced in the event that said roller rotation counter counts up to a predetermined number during said cleaning operation.

7. The image recording apparatus of claim 6, wherein said dirt measuring sensor measures dirt on said supply roller every time said supply roller rotates a predetermined number of times.

8. The image recording apparatus of claim 1, further comprising:

a change rate calculator for calculating a rate of temporal change of dirt on said supply roller during said cleaning operation; and a second notification device for notifying that said supply roller has deteriorated in the event that a calculated rate in said change rate calculator is below a predetermined rate of change.

9. The image recording apparatus of claim 1, further comprising:

a memory storing information about how much dirt said supply roller comes to have in feeding a recording medium, according to the types of recording media;

an input device for entering the number of said recording media to be recorded serially;

an estimator for estimating degree of dirt with reference to said information in said memory and based on a measurement result of said dirt measuring sensor, the type of recording medium and said number of recording media to be recorded; and a third notification device for notifying that said cleaning operation needs to be performed in advance of an image recording operation in the event that an estimated degree of dirt is on or above a predetermined threshold value.

10. An image recording apparatus for recording an image on a sheet-like recording medium using a recording head located to a recording position, comprising:

a supply roller for feeding said recording medium to said recording position;

a cleaning member for making contact with said supply roller to remove dirt from a peripheral surface thereof during a cleaning operation of said supply roller;

a memory storing information about how much dirt said supply roller comes to have in feeding a recording medium, according to the types of recording media;

a dirt measuring sensor for measuring dirt on said supply roller;

an input device for entering the number of said recording media to be recorded serially;

an estimator for estimating degree of dirt with reference to said information in said memory and based on a measurement result of said dirt measuring sensor, the type of recording medium and said number of recording media to be recorded; and a third notification device for notifying that said cleaning operation needs to be performed in advance of an image recording operation in the event that an estimated degree of dirt is on or above a predetermined threshold value.

* * * * *